US009455498B2

(12) United States Patent
Yosui

(10) Patent No.: US 9,455,498 B2
(45) Date of Patent: Sep. 27, 2016

(54) ANTENNA DEVICE AND ELECTRONIC DEVICE

(71) Applicant: Murata Manufacturing Co., Ltd., Nagaokakyo-shi, Kyoto-fu (JP)

(72) Inventor: Kuniaki Yosui, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 195 days.

(21) Appl. No.: 14/474,625

(22) Filed: Sep. 2, 2014

(65) Prior Publication Data

US 2015/0214620 A1 Jul. 30, 2015

Related U.S. Application Data

(63) Continuation of application No. PCT/JP2014/052020, filed on Jan. 30, 2014.

(30) Foreign Application Priority Data

Feb. 13, 2013 (JP) ..... 2013-025125

(51) Int. Cl.

| | |
|---|---|
| ***H01Q 1/22*** | (2006.01) |
| ***H01Q 1/24*** | (2006.01) |
| ***H01Q 7/00*** | (2006.01) |
| ***H01Q 1/38*** | (2006.01) |

(52) U.S. Cl.

CPC ..... *H01Q 7/00* (2013.01); *H01Q 1/2208* (2013.01); *H01Q 1/2266* (2013.01); *H01Q 1/243* (2013.01); *H01Q 1/38* (2013.01)

(58) Field of Classification Search

CPC ..... H01Q 7/00; H01Q 1/2208
See application file for complete search history.

(56) References Cited

U.S. PATENT DOCUMENTS

| | | | | |
|---|---|---|---|---|
| 7,277,060 | B2 * | 10/2007 | Fukuchi | H01Q 13/10 343/767 |
| 2011/0227799 | A1 | 9/2011 | Hashimoto | |
| 2011/0287715 | A1 * | 11/2011 | Matsuura | H01Q 1/243 343/741 |
| 2012/0112971 | A1 * | 5/2012 | Takeyama | H01Q 1/243 343/702 |
| 2012/0176282 | A1 * | 7/2012 | Kato | H01Q 7/00 343/702 |
| 2012/0262357 | A1 | 10/2012 | Kato et al. | |
| 2014/0159974 | A1 | 6/2014 | Kato et al. | |
| 2014/0218261 | A1 * | 8/2014 | Ito | H01Q 7/00 343/866 |

FOREIGN PATENT DOCUMENTS

| | | |
|---|---|---|
| JP | 2002-298095 A | 10/2002 |
| JP | 2011-199343 A | 10/2011 |
| JP | 2012-135020 A | 7/2012 |

OTHER PUBLICATIONS

Official Communication issued in International Patent Application No. PCT/JP2014/052020, mailed on Apr. 8, 2014.

* cited by examiner

*Primary Examiner* — Hoang V Nguyen
*Assistant Examiner* — Michael Bouizza
(74) *Attorney, Agent, or Firm* — Keating & Bennet, LLP

(57) ABSTRACT

An antenna device includes a metal plate and an antenna coil. A main portion of the antenna coil includes an insulating substrate and a coil conductor on the substrate. The metal plate includes a first conductor opening and a second conductor opening. The second conductor opening is continuous with the first conductor opening but not continuous with an outer edge of the metal plate.

19 Claims, 13 Drawing Sheets

ANTENNA DEVICE AND ELECTRONIC DEVICE

BACKGROUND OF THE INVENTION

1. Field of the Invention

The present invention relates to an antenna device preferably for use in a system such as a radio frequency identifier (RFID) system or a short-distance wireless communication system and to an electronic device including the antenna device.

2. Description of the Related Art

An antenna device used in a RFID card reader/writer is disclosed in, for example, Japanese Unexamined Patent Application Publication No. 2002-298095.

When a coil antenna approaches a metal plate, eddy currents usually occur in the metal plate and adversely affect the characteristics of the coil antenna. To address such an effect, a typical antenna device includes a magnetic sheet interposed between the coil antenna and the metal plate, as illustrated in Japanese Unexamined Patent Application Publication No. 2002-298095.

In the antenna device disclosed in Japanese Unexamined Patent Application Publication No. 2002-298095, the magnetic body shields the magnetic field of the coil antenna, so that eddy currents are prevented from occurring in the metal plate. Thus, the antenna device is capable of communicating with a communication counterpart antenna when the communication counterpart antenna is located on the side of the antenna device on which the coil antenna is located.

However, since the magnetic body and the metal plate shield the magnetic field of the coil antenna, the antenna device is not capable of communicating with a communication counterpart antenna when the communication counterpart antenna is located on the metal-plate side of the antenna device.

SUMMARY OF THE INVENTION

Preferred embodiments of the present invention provide an antenna device that includes a loop-shaped or spiral-shaped coil conductor and an areally spreading plane conductor disposed opposite to a coil opening of the coil conductor, the antenna device being configured to perform communication through either a side on which the coil conductor is disposed or a plane-conductor side. Preferred embodiments of the present invention also provide an electronic device including such a novel antenna device.

According to a preferred embodiment of the present invention, an antenna device includes a loop-shaped or spiral-shaped coil conductor and an areally spreading plane conductor disposed to face a coil opening of the coil conductor, wherein the plane conductor includes a first conductor opening and a second conductor opening, wherein the coil opening overlaps the first conductor opening when the coil conductor is viewed in a plan, and wherein the second conductor opening is continuous with the first conductor opening but not continuous with an outer edge of the plane conductor. This structure enables the antenna device to perform communication through either its side on which the coil conductor is disposed or its side on which the areally spreading conductor is disposed.

Preferably, the first conductor opening and the second conductor opening are provided on the same plane. This structure makes a simple plane conductor usable as a booster antenna.

Preferably, an end of the second conductor opening extends to a position at which an electric current induced in a conductor by the coil conductor takes a value that is half or about half of a maximum value or less. This structure prevents the electric current that bypasses the ends of the second conductor opening (passes a shortcut) from cancelling the magnetic field, such that the areally spreading conductor is configured to be used as a booster antenna.

Preferably, the plane conductor is a grounded conductor provided on a circuit board. This structure dispenses with special provision of an areally spreading conductor that defines and serves as a booster antenna.

Preferably, an entirety or a portion of a metal housing that houses the coil conductor defines and serves as the plane conductor. This structure dispenses with special provision of an areally spreading conductor that serves as a booster antenna.

An electronic device according to another preferred embodiment of the present invention is an electronic device including the antenna device having the above structure and the electronic device includes a communication circuit connected to the coil conductor.

According to various preferred embodiments of the present invention, an antenna device that includes a coil conductor and an areally spreading plane conductor is configured to perform communication through either a side on which the coil conductor is disposed or a side on which the areally spreading plane conductor is disposed while suppressing the effect of the plane conductor.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
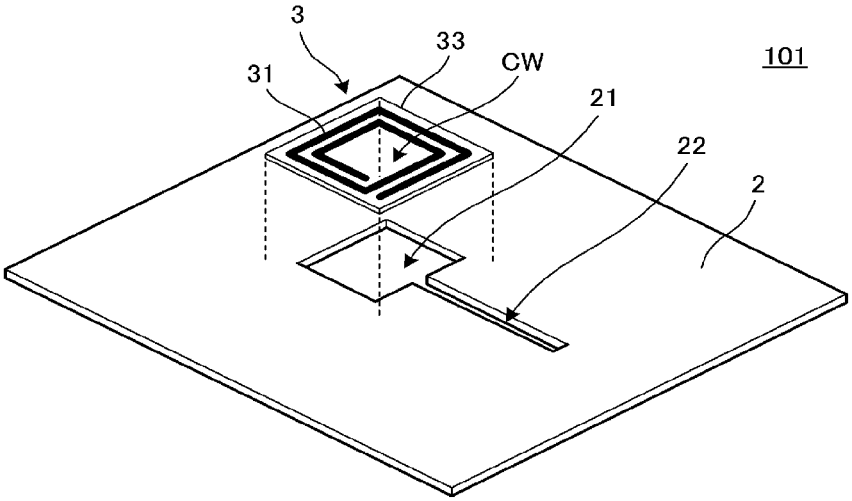
FIG. 1 is an exploded perspective view of an antenna device 101 according to a first preferred embodiment of the present invention.

FIG. 1 is an exploded perspective view of an antenna device 101 according to a first preferred embodiment of the present invention. The antenna device 101 includes a metal plate 2 and an antenna coil 3. A main portion of the antenna coil 3 includes an insulating substrate 33 and a coil conductor 31 provided on the substrate 33. The metal plate 2 corresponds to a "plane conductor" according to preferred embodiments of the present invention and includes a first conductor opening 21 and a second conductor opening 22.

In FIG. 1, a coil opening CW of the coil conductor 31 and the metal plate 2 are arranged to face each other and the antenna coil and the metal plate are located close to each other so that magnetic field coupling occurs between the antenna coil and the metal plate.

In the example illustrated in FIG. 1, the first conductor opening 21 is rectangular or substantially rectangular, similar to the shape of the coil conductor 31 and the shape of the coil opening CW. The first conductor opening 21 is arranged so as to be overlapped by the coil opening CW when viewed in a plan. The second conductor opening 22 is continuous with the first conductor opening 21 but is not continuous with the outer edge of the metal plate 2. In other words, the first conductor opening 21 and the second conductor opening 22 are continuous with each other and are enclosed without touching the outer edge of the metal plate 2. Although the first conductor opening 21 is preferably rectangular or substantially rectangular in FIG. 1, the first conductor opening 21 does not necessarily have to be rectangular or substantially rectangular. The shape of the first conductor opening 21 can be changed in accordance of the purpose of use such as a reduction of unneeded coupling with peripheral components or an effective use of an antenna mounted space.

Figure 2A:
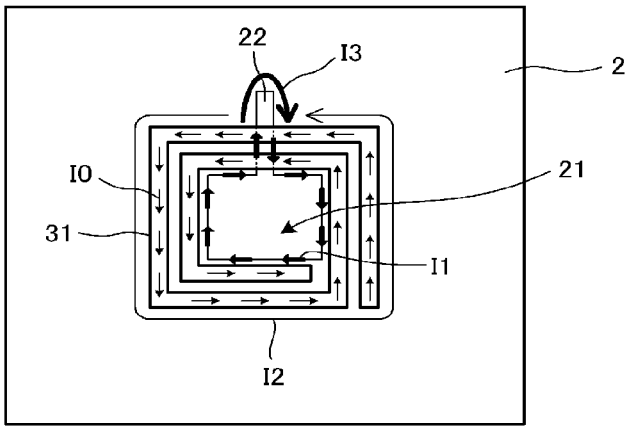
FIGS. 2A to 2C illustrate an electric current flowing through a coil conductor 31 and an electric current flowing through a metal plate 2.
Figure 2B:
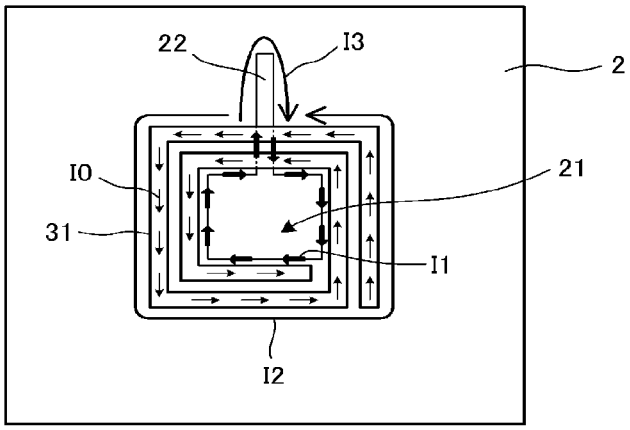
Figure 2C:
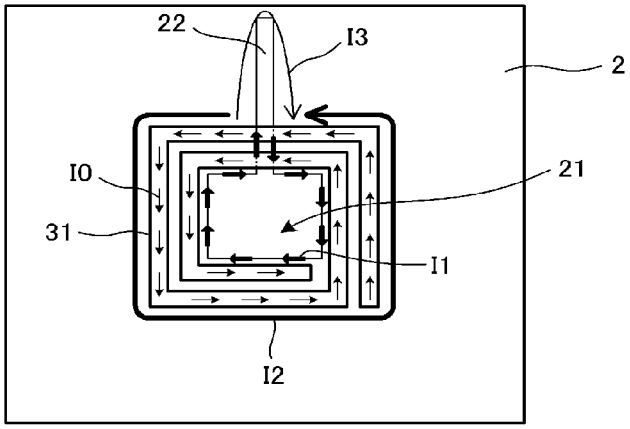

FIGS. 2A, 2B, and 2C illustrate an electric current flowing through the coil conductor 31 and an electric current flowing through the metal plate 2. The second conductor opening 22 provided in the metal plate 2 varies in length between FIGS. 2A, 2B, and 2C.

In each of FIGS. 2A, 2B, and 2C, when an electric current I0 flows through the coil conductor 31, the coil conductor 31 and the metal plate 2 are coupled together via an electromagnetic field, so that an electric current is induced in the metal plate 2. Specifically, an electric current I1 flows mainly along the edge of the first conductor opening 2 and this electric current is diverted into an electric current flowing along the edge of the second conductor opening (slit) 22 and an electric current flowing around the first conductor opening 21 and along the outer edge of the metal plate 2. Specifically, an electric current I3 flows along the edge of the second conductor opening (slit) 22 and an electric current I2 flows around the first conductor opening 21 and along the outer edge of the metal plate 2. In FIGS. 2A, 2B, and 2C, this electric current I2 is drawn by a single line for the purpose of simplicity of illustration.

In FIGS. 2A, 2B, and 2C, the intensity of the electric currents I1, I2, and I3 is represented by the thickness of the lines. As illustrated in FIG. 2A, when the second conductor opening 22 is short, the intensity of the electric current I3 flowing along the edge of the second conductor opening 22 is high and, accordingly, the intensity of the electric current I2 is low. When the second conductor opening 22 is made longer, as illustrated in FIGS. 2B and 2C, the intensity of the electric current I3 flowing along the edge of the second conductor opening 22 decreases and, accordingly, the intensity of the electric current I2 increases.

The electric current I2 flows in the same direction as the direction in which the electric current I0 flows through the coil conductor 31. Thus, the fact that the electric current I2 flows through the metal plate 2 means that the electromagnetic-field shielding effect of the metal plate 2 is reduced. When the electromagnetic field caused by the electric current I2 is larger than the electromagnetic field caused by the electric current I1 flowing along the edge of the first conductor opening 21, the metal plate 2 acts as a booster antenna. Since the path of the electric current I2 is extended farther than the path of the electric current I1, the electromagnetic-field radiation effect produced by the electric current I2 is larger than the electromagnetic-field radiation effect produced by the electric current I1. Usually, when half of the amount of the electric current I1 flows as the electric current I2, the metal plate 2 exerts an effect of a booster antenna. Thus, the metal plate 2 acts as a booster antenna when the amount of the electric current I2 that flows around the first conductor opening 21 and along the outer edge of the metal plate 2 is larger than the amount of the electric current I3 that flows along the edge of the second conductor opening 22.

The second conductor opening 22, even when it is short, reduces the electromagnetic-field shielding effect of the metal plate 2. However, it is preferable that the second conductor opening 22 be sufficiently long so as to make the amount of the electric current I2 larger than the amount of the electric current I3.

Figure 3:
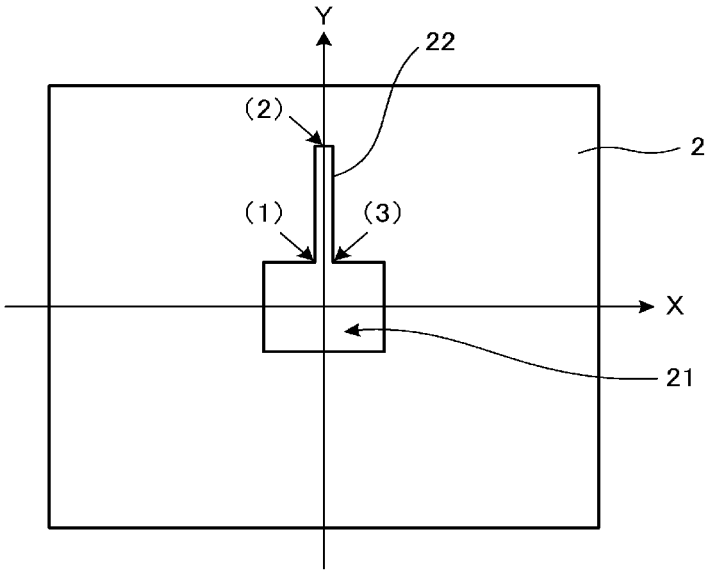
FIG. 3 illustrates three positions along the edges of a first conductor opening 21 and a second conductor opening 22 formed in the metal plate 2.

FIG. 3 illustrates three positions along the edges of the first conductor opening 21 and the second conductor opening 22 provided in the metal plate 2. Here, it is preferable that the second conductor opening 22 be configured so that, when the amount of electric current flowing at the joint points (1) and (3) of the second conductor opening 22 is taken as 100%, the amount of electric current flowing at or around a midpoint (2) of the path along which the electric current I3 illustrated in FIGS. 2A, 2B, and 2C flows (at or around the top end of the second conductor opening 22 in FIG. 3) is smaller than or equal to 50%, for example.

Figure 4A:
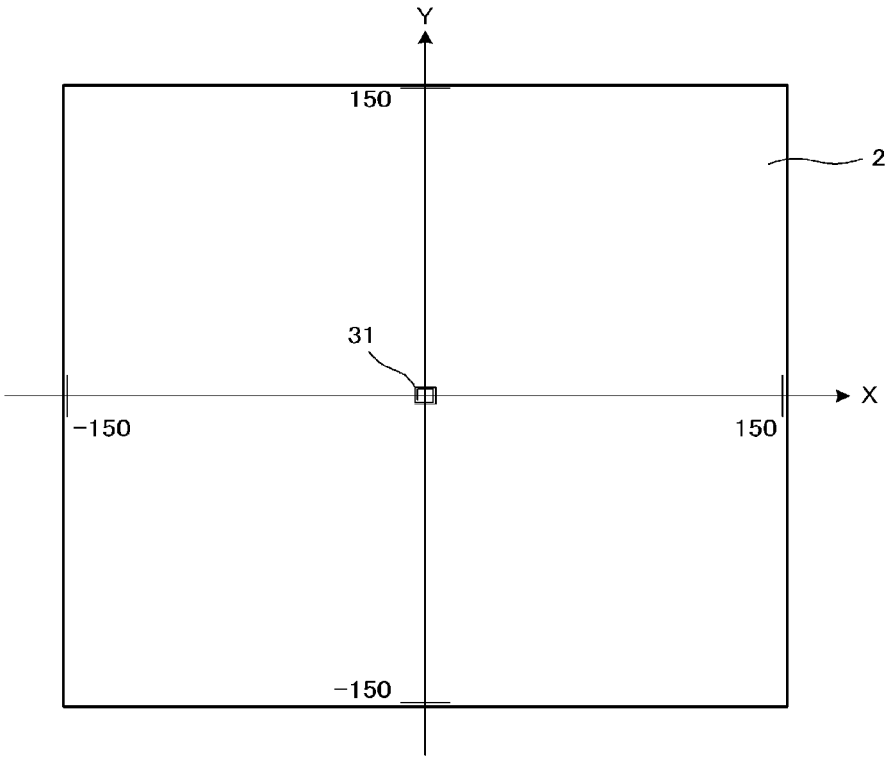
FIGS. 4A and 4B are plan views of a simulation model of the antenna device.
Figure 4B:
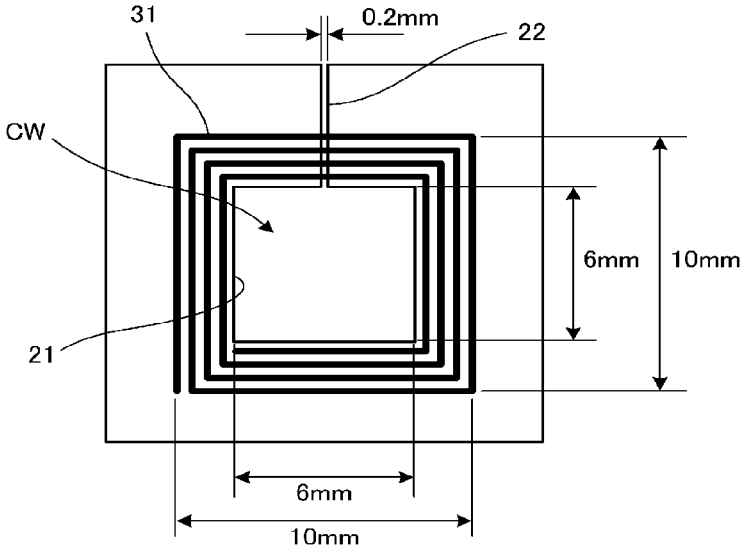

FIGS. 4A and 4B are plan views of a simulation model of an antenna device. FIG. 4A is a plan view of the entire antenna device while FIG. 4B is an enlarged plan view of a portion at which the coil conductor is located. The metal plate 2 preferably has dimensions of approximately 150 mm×150 mm, for example. The dimensions of the coil conductor 31 and the dimensions of the first and second conductor openings 21 and 22 preferably are as illustrated in FIG. 4B. A communication counterpart antenna has a flat coil shape preferably having dimensions of about 54 mm×about 86 mm, for example. The antenna device illustrated in FIG. 4A and the communication counterpart antenna are disposed so as to face each other and spaced about 20 mm, for example, apart from each other on the Z axis while the center of the antenna device and the center of the communication counterpart antenna coincide with each other.

Figure 5:
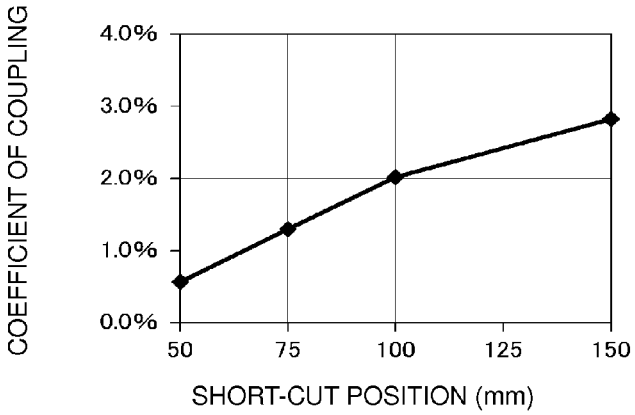
FIG. 5 is a graph showing a relationship between the length of the second conductor opening 22 of the simulation model and the coefficient of coupling between a target antenna device and a communication counterpart antenna.

FIG. 5 is a graph showing a relationship between the length of the second conductor opening 22 of the simulation model and the coefficient of coupling between a target antenna device and a communication counterpart antenna. The horizontal axis in FIG. 5 indicates the length from the joint points of the second conductor opening 22 to the top end (short-cut position) of the second conductor opening 22 while the vertical axis in FIG. 5 indicates the coefficient of coupling. As illustrated in FIG. 5, the coefficient of coupling increases as the short-cut position of the second conductor opening 22 rises (as the second conductor opening 22 is lengthened). Here, the coefficient of coupling in the case where an antenna device does not include metal plate 2 is approximately 2%, for example. Thus, in the case where the short-cut position of the second conductor opening 22 arrives at or exceeds 100 mm, the existence of the metal plate 2 produces a booster effect.

Figure 6:
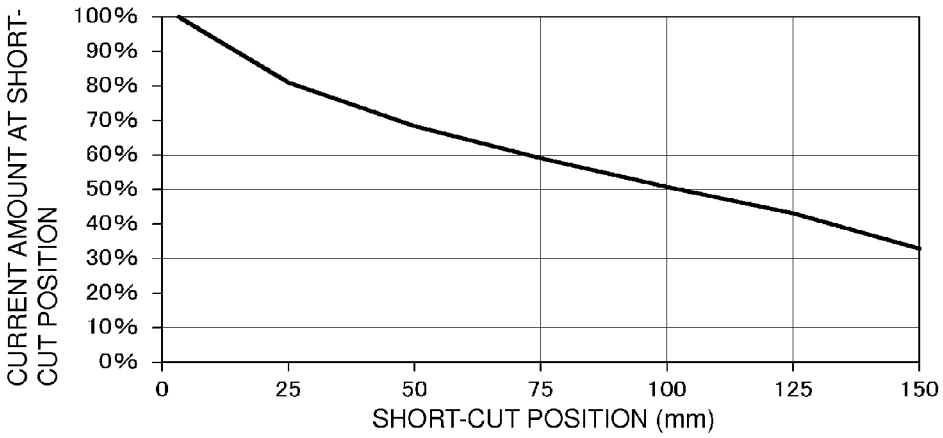
FIG. 6 is a graph showing a relationship between the length of the second conductor opening 22 of the simulation model and the amount of current flow at the top end (short-cut position) of the second conductor opening 22.

FIG. 6 is a graph showing a relationship between the length of the second conductor opening 22 of the simulation model and the amount of current flow at the top end (short-cut position) of the second conductor opening 22. The horizontal axis of FIG. 6 indicates the length from the joint points of the second conductor opening 22 to the top end of the second conductor opening 22 (short-cut position) and the vertical axis indicates the amount of electric current at or around the top end when the amount of electric current flowing at the joint points (positions (1) and (3) illustrated in FIG. 3) of the second conductor opening 22 is taken as 100%. As illustrated in FIG. 6, the amount of electric current at or around the short-cut position of the second conductor opening 22 decreases as the short-cut position of the second conductor opening 22 rises (as the second conductor opening 22 is lengthened). When the percentage arrives at or falls below 50% (when the short-cut position of the second conductor opening 22 rises up to about 100 mm or higher), the existence of the metal plate 2 produces a booster effect.

Second Preferred Embodiment

Figure 7A:
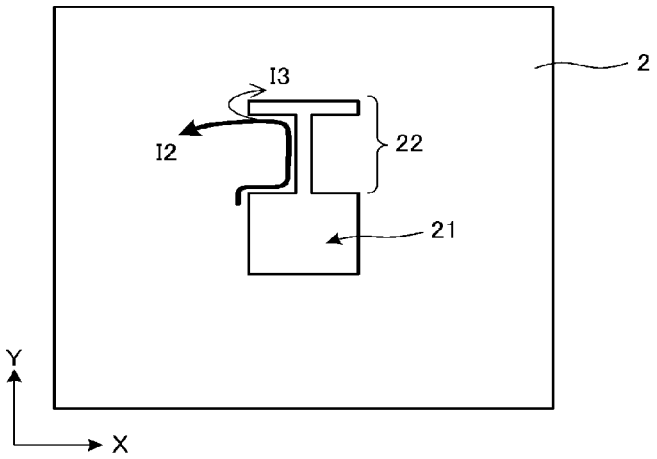
FIGS. 7A, 7B, and 7C are plan views of metal plates of three antenna devices according to a second preferred embodiment of the present invention.
Figure 7B:
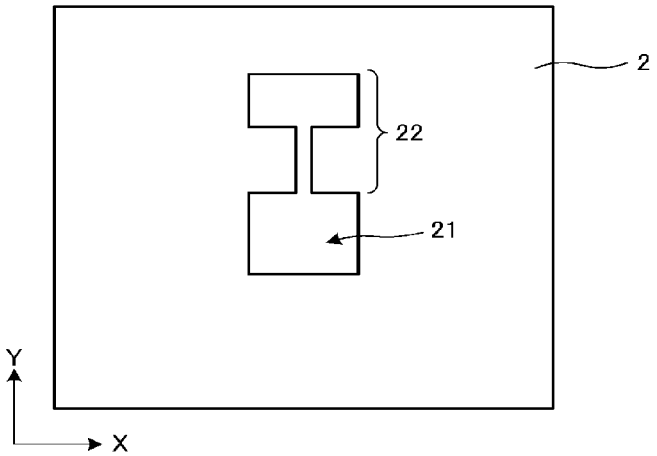
Figure 7C:
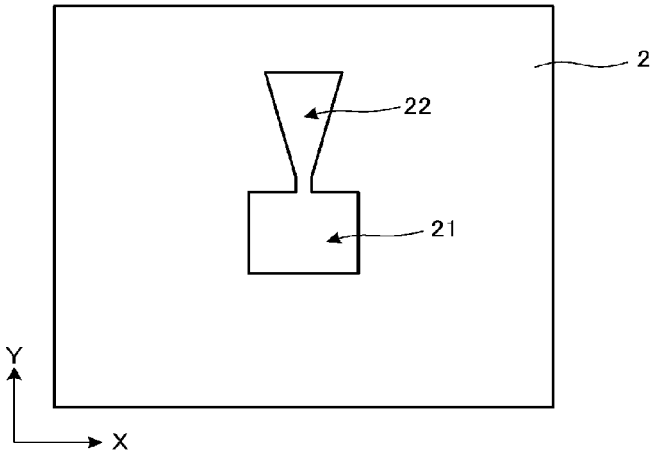

FIGS. 7A, 7B, and 7C are plan views of metal plates of three antenna devices according to a second preferred embodiment of the present invention. The first preferred embodiment describes an example in which a simple slit-shaped second conductor opening 22 protrudes from the rectangular or substantially rectangular first conductor opening 21, but the shape of the second conductor opening 22 is not limited to a simple slit shape. As illustrated in FIG. 7A, the second conductor opening 22 may have a T shape in which a slit extending from the first conductor opening 21 bifurcates halfway. As illustrated in FIG. 7B, alternatively, the slit extending from the first conductor opening 21 may have a large width at the end. Still alternatively, as illustrated in FIG. 7C, the slit extending from the first conductor opening 21 may be widened toward the end.

In the antenna device including either one of the metal plates illustrated in FIGS. 7A, 7B, and 7C, the electric current flowing from the joint points of the second conductor opening 22 toward the top end is diverted into the electric current I2 and the electric current I3. Since the top end of the second conductor opening 22 is widened in the X axis direction, the electric current I2 is more easily induced. Thus, the amount of electric current at or around the short-cut position of the second conductor opening 22 is reduced even though the distance by which the second conductor opening 22 protrudes from the first conductor opening 21 is small, such that the coefficient of coupling between the antenna device and the communication counterpart antenna is significantly increased.

Third Preferred Embodiment

Figure 8A:
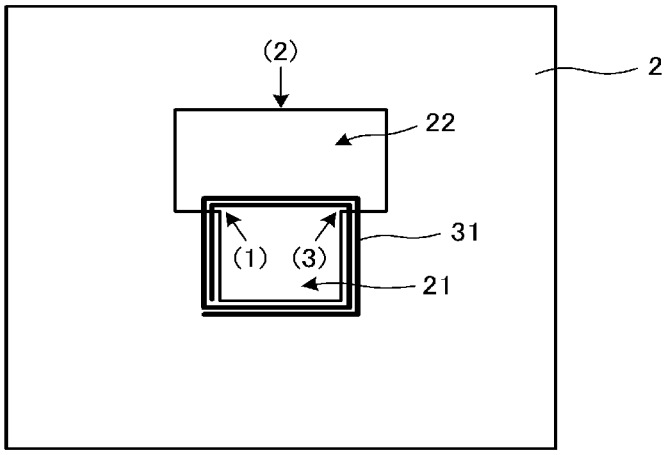
FIG. 8A is a plan view of an antenna device according to a third preferred embodiment of the present invention.
Figure 8B:
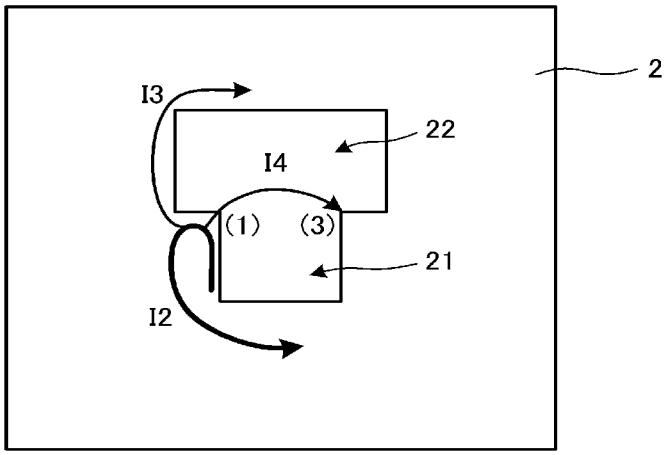
FIG. 8B is a plan view of a metal plate 2 included in the antenna device.

FIG. 8A is a plan view of an antenna device according to a third preferred embodiment of the present invention. FIG. 8B is a plan view of a metal plate 2 included in the antenna device. As illustrated in FIG. 8A, the coil conductor 31 is located along three sides of the first conductor opening 21. The width (extending between left and right in the drawing) of the second conductor opening 22 is larger than the width of the first conductor opening 21.

As illustrated in FIG. 8B, an electric current flowing along the edge of the first conductor opening 21 is diverted at the joint points (1) and (3) of the second conductor opening. The electric current I2 flows around the first conductor opening and along the outer edge of the metal plate 2 and the electric current I3 flows along the edge of the second conductor opening 22. The distance between the joint points (1) and (3) of the second conductor opening is wide and the capacitance between the joint points (1) and (3) is small, such that a displacement current I4 that is to flow between the joint points (1) and (3) is small. Consequently, the amount of the electric current I2 increases, such that a booster effect is obtained.

Figure 9:
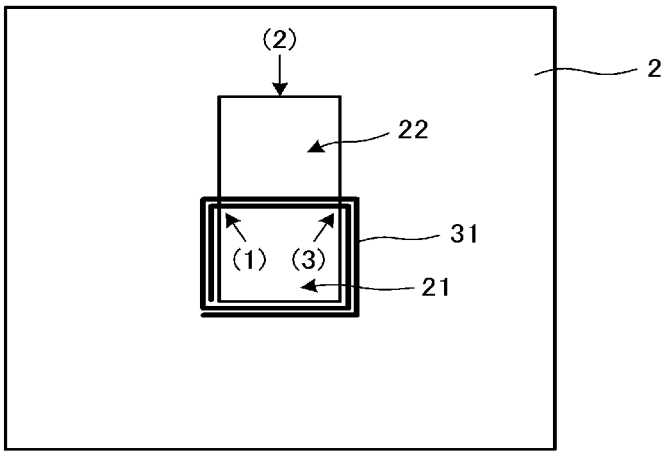
FIG. 9 is a plan view of another antenna device according to the third preferred embodiment of the present invention.

The antenna device illustrated in FIG. 8A is an example where the width of the second conductor opening 22 is larger than the width of the first conductor opening. As illustrated in FIG. 9, however, the width of the first conductor opening 21 and the width of the second conductor opening 22 may be equal or substantially equal to each other. In this case, the region enclosed by the coil conductor 31 in a plan view serves as the first conductor opening 21 and the remaining region serves as the second conductor opening 22. The joint points of the second conductor opening 22 are the positions (1) and (3) illustrated in the drawing.

Fourth Preferred Embodiment

Figure 10A:
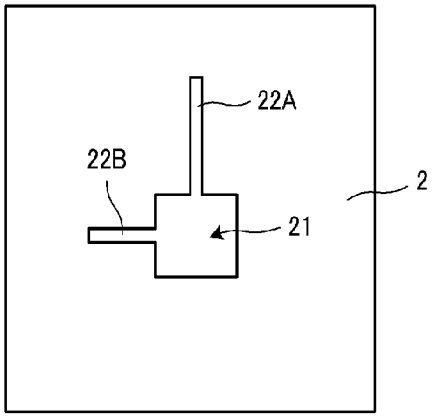
FIGS. 10A to 10F are plan views of metal plates of an antenna device according to a fourth preferred embodiment of the present invention.
Figure 10B:
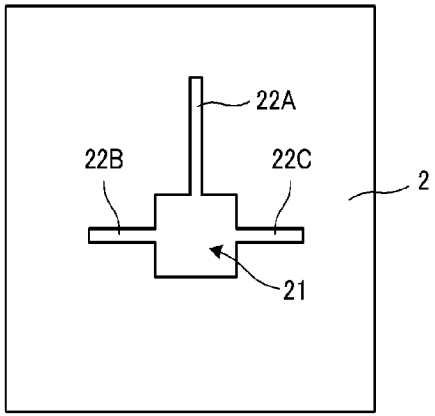
Figure 10C:
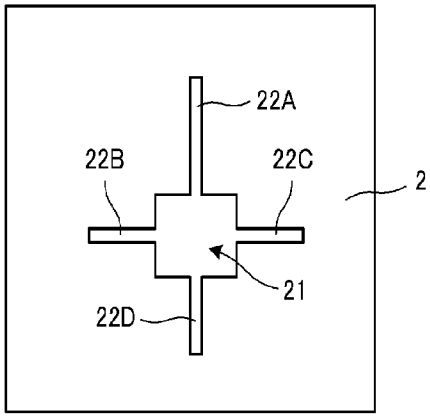

Each of FIGS. 10A to 10F is a plan view of a metal plate included in an antenna device according to a fourth preferred embodiment of the present invention. In either example, the metal plate 2 includes a first conductor opening 21 and second conductor openings 22. The preferred embodiments disclosed thus far describe examples in which one second conductor opening 22 preferably is provided for each first conductor opening 21, for example. However, as illustrated in FIGS. 10A, 10B, and 10C, multiple second conductor openings 22 may be provided. The metal plate 2 of the example illustrated in FIG. 10A includes two second conductor openings 22A and 22B. The metal plate 2 of the example illustrated in FIG. 10B includes three second conductor openings 22A, 22B, and 22C. The metal plate 2 of the example illustrated in FIG. 10C includes four second conductor openings 22A, 22B, 22C, and 22D.

Figure 10D:
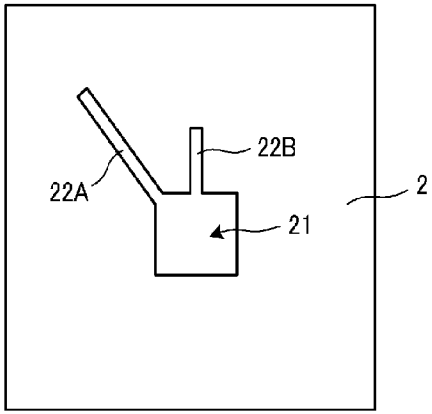
Figure 10E:
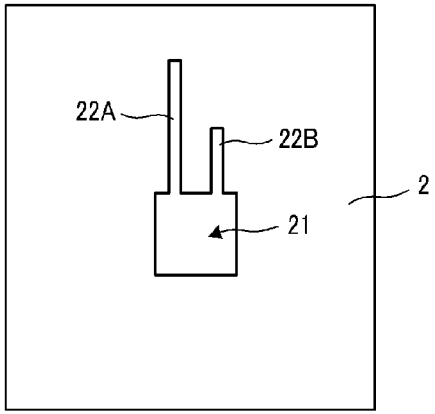

Moreover, when multiple second conductor openings are to be provided, the angle at which adjacent second conductor openings cross each other is not limited to 90 degrees or 180 degrees. For example, as illustrated in FIG. 10D, a second conductor opening 22A may extend obliquely to a second conductor opening 22B. As illustrated in FIG. 10E, two second conductor openings 22A and 22B may extend in the same direction. Here, an entirety or a portion of second conductor openings may be bent.

Figure 10F:
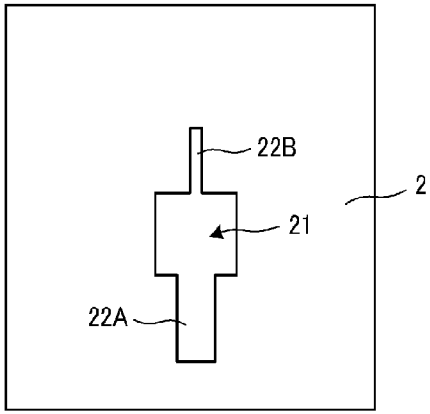

When multiple second conductor openings are to be provided, the openings may have different widths as in the case of second conductor openings 22A and 22B illustrated in FIG. 10F.

Fifth Preferred Embodiment

Figure 11:
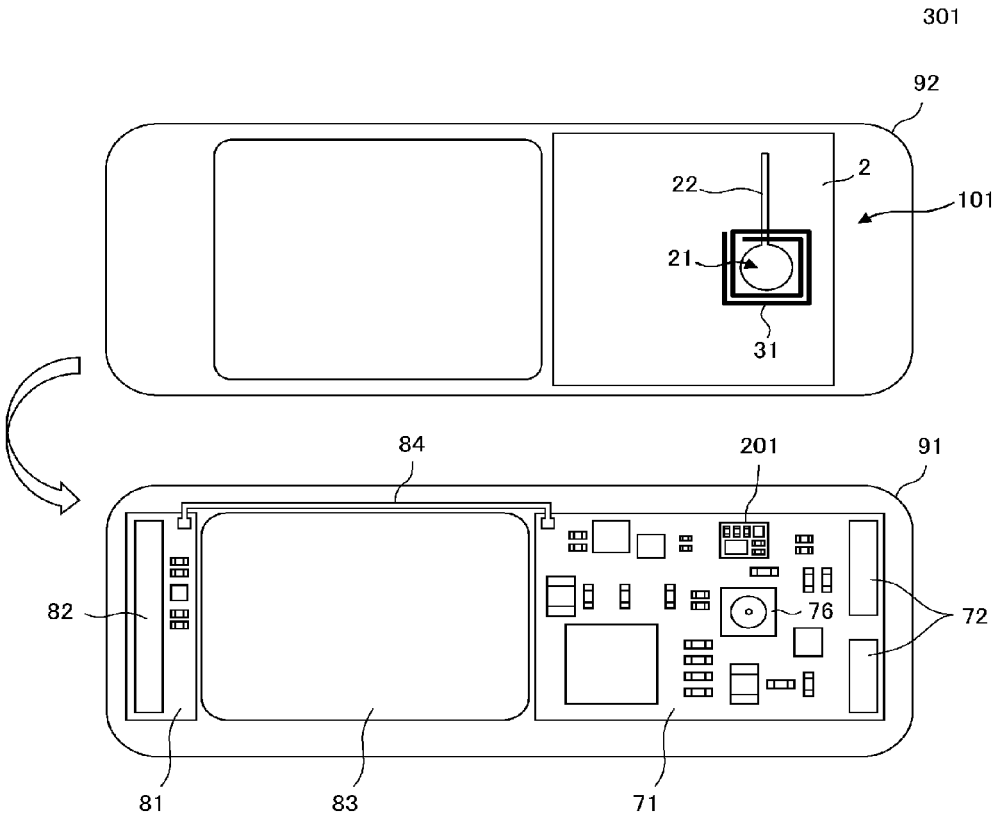
FIG. 11 illustrates an internal structure of a housing of an electronic device 301 according to a fifth preferred embodiment of the present invention in a plan view in the state where a first housing 91 and a second housing 92 are detached from each other to expose the inside.

FIG. 11 illustrates an internal structure of a housing of an electronic device 301 according to a fifth preferred embodiment of the present invention in a plan view in the state where a first housing 91 and a second housing 92 are detached from each other to expose the inside. The electronic device 301 preferably is, for example, a mobile phone terminal or a tablet personal computer (PC) and includes an antenna device 101 having a structure according to either one of the preferred embodiments and a module 201 on which an antenna coil is mounted. The module preferably is a module for high-frequency (HF) radio-frequency identification (RFID) and is configured to perform, for example, near field communication (NFC). Specifically, the antenna device is preferably for use as an HF antenna.

The first housing 91 contains components such as printed circuit boards 71 and 81 and a battery pack 83. An antenna-coil built-in module is mounted on the printed circuit board 71. Components such as an ultra-high-frequency (UHF) antenna 72 and a camera module 76 are mounted on the printed circuit board 71. Components such as a UHF antenna 82 are mounted on the printed circuit board 81. The printed circuit board 71 and the printed circuit board 81 are connected together using a coaxial cable 84.

An antenna device 101 is located on the inner surface of the second housing 92. A first conductor opening 21 provided in the metal plate 2 of the antenna device 101 is located so as to correspond to the camera module 76. The first conductor opening 21 also serves as a window at the position of a camera lens. The antenna device 101 causes magnetic-field coupling with an antenna coil (feed coil) of the module 201 on which the feeding antenna coil is mounted.

The metal plate 2 may be integrated with a resin-made housing. The entirety or a portion of the metal housing may define and serve as a metal plate.

An antenna device may have a configuration in which a first conductor opening and a second conductor opening are provided in a grounded conductor provided in a printed circuit board and a coil conductor is disposed near the first conductor opening.

Sixth Preferred Embodiment

Figure 12:
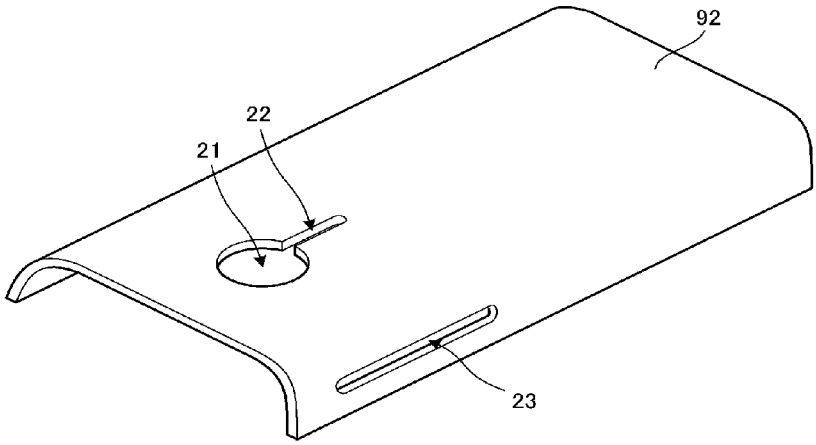
FIG. 12 is a perspective view of a portion of a housing of an electronic device according to a sixth preferred embodiment of the present invention.

FIG. 12 is a perspective view of a portion of a housing of an electronic device according to a sixth preferred embodiment of the present invention. This electronic device preferably is, for example, a mobile phone terminal or a tablet PC. The housing illustrated in FIG. 12 is a housing that comes on the side opposite the side on which a display panel is disposed and is molded out from a metal plate. In the case of such a metal housing, for example, a camera lens window is configured to be used as the first conductor opening 21. Alternatively, a through hole 23 for an earphone jack, a card slot, a press button, or the like may be used as the first conductor opening or the second conductor opening.

Seventh Preferred Embodiment

Figure 13A:
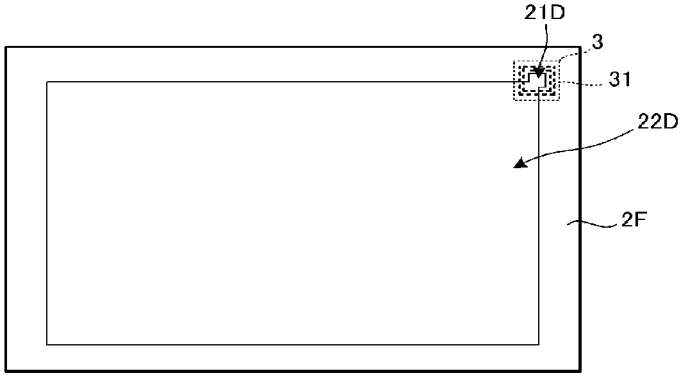
FIGS. 13A and 13B illustrate a configuration of an electronic device according to a seventh preferred embodiment of the present invention.
Figure 13B:
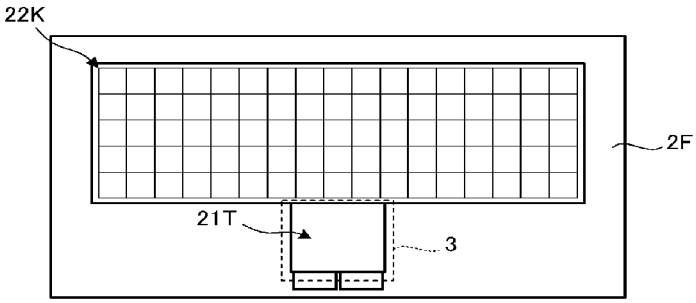

FIGS. 13A and 13B illustrate a configuration of an electronic device according to a seventh preferred embodiment of the present invention. FIG. 13A illustrates an example in which an antenna device is included in a PC monitor (display) and FIG. 13B illustrates an example in which an antenna device is included in a PC keyboard.

In the example illustrated in FIG. 13A, a metal frame 2F of a PC monitor (display) is used as a "plane conductor", one corner portion 21D of the metal frame 2F is used as a first conductor opening, and a display portion 22D is used as a second conductor opening. In other words, by disposing an antenna coil 3 at the corner portion 21D of the metal frame, the metal frame 2F is caused to act as a booster antenna.

In the example illustrated in FIG. 13B, a metal frame 2F of a PC keyboard is used as a "plane conductor", a touch pad portion 21T of the metal frame 2F is used as a first conductor opening, and a keyboard portion 22K is used as a second conductor opening. In other words, by disposing an antenna coil 3 at the touch pad portion 21T, the metal frame 2F is caused to act as a booster antenna.

Eighth Preferred Embodiment

Figure 14A:
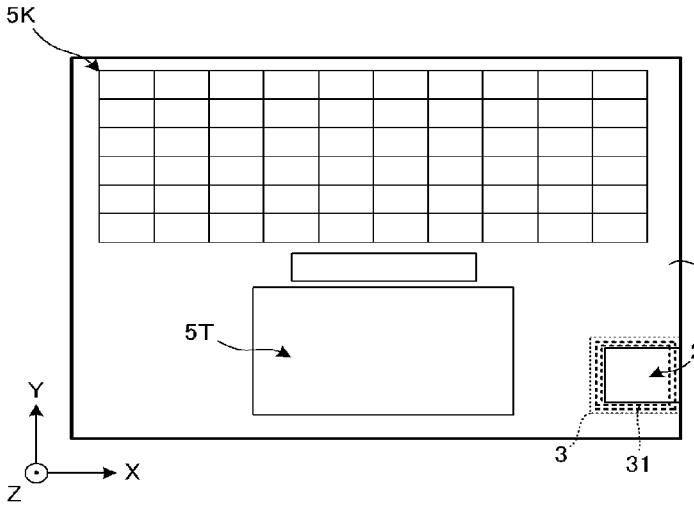
FIGS. 14A and 14B illustrate a configuration of an electronic device according to an eighth preferred embodiment of the present invention.
Figure 14B:
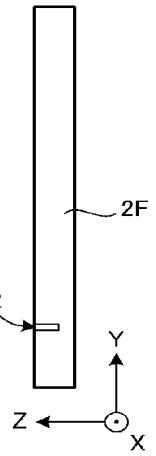

FIGS. 14A and 14B illustrate a configuration of an electronic device according to an eighth preferred embodiment of the present invention.

FIG. 14A is a front view of a keyboard and FIG. 14B is a right view of the keyboard.

The keyboard includes a keyboard portion 5K and a touch pad portion 5T. In this preferred embodiment, a first conductor opening 21 is provided at a portion of a front surface of the metal frame 2F of the keyboard and a second conductor opening 22 is provided at a portion of a side surface of the metal frame 2F. A coil conductor 31 of an antenna coil 3 is disposed around the first conductor opening 21 of the metal frame 21.

The width of the first conductor opening 21 (the opening width in the Y axis direction in FIGS. 14A and 14B) is larger than the width of the second conductor opening 22.

By providing the first conductor opening 21 and the second conductor opening 22 in the metal frame 2F of a keyboard in this manner (by providing special-purpose conductor openings without utilizing existing conductor openings), the metal frame 2F is configured to be used as a "plane conductor" and caused to act as a booster antenna.

Ninth Preferred Embodiment

Figure 15A:
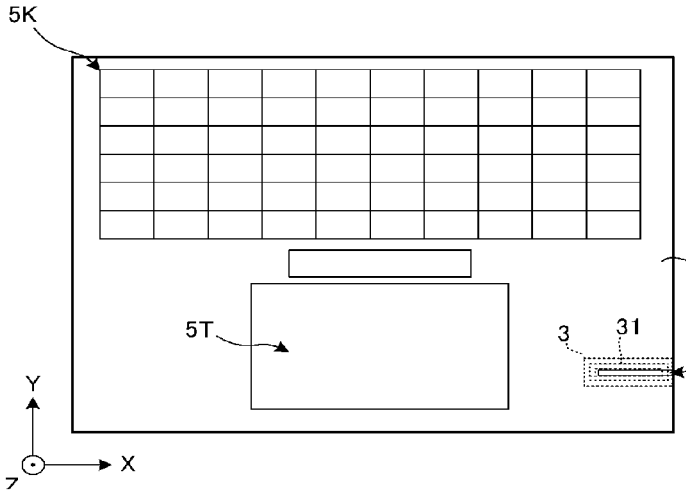
FIGS. 15A and 15B illustrate a configuration of an electronic device according to a ninth preferred embodiment of the present invention.
Figure 15B:
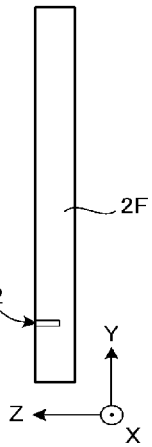

FIGS. 15A and 15B illustrate a configuration of an electronic device according to a ninth preferred embodiment of the present invention.

FIG. 15A is a front view of a keyboard and FIG. 15B is a right view of the keyboard.

Unlike in the case illustrated in FIGS. 14A and 14B, in this preferred embodiment, the width of the first conductor opening 21 (the opening width in the Y axis direction in FIGS. 15A and 15B) is equal or substantially equal to the width of the second conductor opening 22. The first conductor opening 21 has a thin shape extending inwardly from the edge of the metal frame 2F. Accordingly, the range over which the coil conductor 31 is formed is thin. Other components are preferably the same as those illustrated in the eighth preferred embodiment.

In this manner, even in the case where the width of the first conductor opening 21 and the width of the second conductor opening 22 are equal or substantially equal to each other, the metal frame 2F is configured to be utilized as a "plane conductor" and caused to act as a booster antenna.

Tenth Preferred Embodiment

Figure 16A:
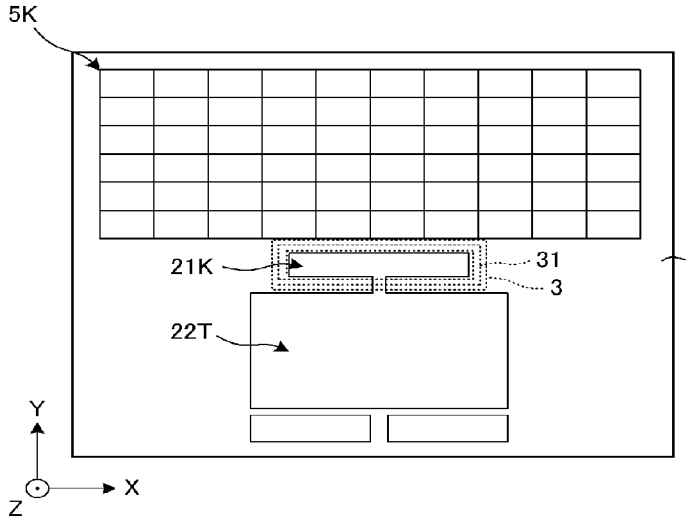
FIGS. 16A and 16B illustrate a configuration of an electronic device according to a tenth preferred embodiment of the present invention.
Figure 16B:
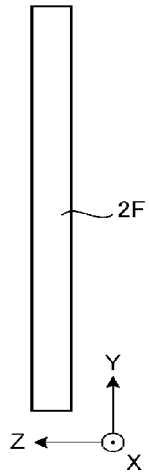

FIGS. 16A and 16B illustrate a configuration of an electronic device according to a tenth preferred embodiment of the present invention.

FIG. 16A is a front view of a keyboard and FIG. 16B is a right view of the keyboard. In this preferred embodiment, a conductor opening of a space key (wide button) 21K of a metal frame 2F is utilized as a first conductor opening and a conductor opening of a touch pad portion 22T is utilized as a second conductor opening. A coil conductor 31 of an antenna coil 3 is arranged around the conductor opening of the space key 21K.

In this manner, the conductor opening of the touch pad portion 22T preferably is utilized as a second conductor opening. As illustrated in this example, the width of the second conductor opening (the width of the touch pad portion 22T in the X axis direction) preferably is larger than the width of the first conductor opening (the width of the space key 21K in the X axis direction).

Other Preferred Embodiments

As illustrated in the seventh to tenth preferred embodiments of the present invention, an existing conductor opening or openings may preferably be utilized as either one or both of the first conductor opening and the second conductor opening or new conductor openings may preferably be exclusively provided for both the first conductor opening and the second conductor opening.

The examples of various preferred embodiments of the present invention have been described with regard to an HF RFID. Besides the HF range, preferred embodiments of the present invention are similarly applicable to a UHF system usable for the purposes of, such as wireless LAN.

Although the above-described examples include a spiral-shaped coil conductor, the coil conductor may appropriately have a loop shape having one turn or the coil conductor may have a multilayer structure. Moreover, besides rectangular or substantially rectangular, the coil conductor may have any shape, in a plan view, with which the coil conductor can cause electromagnetic-field coupling with the first conductor opening.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device comprising:

a loop-shaped or spiral-shaped coil conductor; and an areally spreading plane conductor disposed to face a coil opening of the coil conductor; wherein the plane conductor includes a first conductor opening and a second conductor opening;

the coil opening overlaps the first conductor opening when the coil conductor is viewed in a plan; and the second conductor opening is continuous with the first conductor opening but not continuous with an outer edge of the plane conductor.

2. The antenna device according to claim 1, wherein the first conductor opening and the second conductor opening are located on the same plane.

3. The antenna device according to claim 1, wherein an end of the second conductor opening extends to a position at which an electric current induced in a conductor by the coil conductor takes a value that is half or about half of a maximum value or less.

4. The antenna device according to claim 1, wherein the plane conductor is a grounded conductor located on a circuit board.

5. The antenna device according to claim 1, wherein an entirety or a portion of a metal housing that houses the coil conductor defines the plane conductor.

6. The antenna device according to claim 1, wherein the plane conductor includes a metal plate.

7. The antenna device according to claim 6, wherein the metal plate defines and functions as a booster antenna.

8. The antenna device according to claim 1, wherein the first conductor opening is rectangular or substantially rectangular.

9. The antenna device according to claim 1, wherein the second conductor opening is one of slit-shaped, T-shaped, and widened at an end thereof.

10. The antenna device according to claim 1, wherein the coil conductor extends along three sides of the first conductor opening.

11. The antenna device according to claim 1, wherein a width of the second conductor opening is larger than a width of the first conductor opening.

12. The antenna device according to claim 1, wherein a width of the second conductor opening is equal or substantially equal to a width of the first conductor opening.

13. The antenna device according to claim 1, further comprising a plurality of the second conductor openings.

14. The antenna device according to claim 13, wherein the plurality of the second conductor opening have different widths.

15. An electronic device including the antenna device according to claim 1, further comprising a communication circuit connected to the coil conductor.

16. An electronic device according to claim 15, wherein the electronic device is one of a phone, a computer, a computer monitor, and a keyboard.

17. An electronic device according to claim 15, wherein the plane conductor is defined by a metal housing or frame of the electronic device.

18. An electronic device according to claim 15, wherein the electronic device is configured to perform communication in one of an HF range and a UHF range.

19. An electronic device according to claim 15, wherein the electronic device is configured to perform communication in an RFID system.

* * * * *